US005625389A

United States Patent [19]

Eriksen et al.

[11] Patent Number: 5,625,389

[45] Date of Patent: Apr. 29, 1997

[54] INK-JET PRINT HEAD ARRAY AND INTERLACE METHOD

[75] Inventors: Joern B. Eriksen, Oregon City; Michael D. Stevens, Portland; Howard V. Goetz, Tigard, all of Oreg.

[73] Assignee: Tektronix, Inc., Wilsonville, Oreg.

[21] Appl. No.: 189,336

[22] Filed: Jan. 31, 1994

[51] Int. Cl.[6] ..... B41J 2/15

[52] U.S. Cl. ..... 347/41

[58] Field of Search ..... 347/41, 40, 43

[56] References Cited

U.S. PATENT DOCUMENTS

| | | | |
|---|---|---|---|
| 4,750,009 | 6/1988 | Yoshimura | 347/43 |
| 4,801,950 | 1/1989 | Frehling | 347/239 |
| 4,967,203 | 10/1990 | Doan et al. | 346/1.1 |
| 4,978,971 | 12/1990 | Goetz et al. | 346/1.1 |
| 4,999,646 | 3/1991 | Trask | 346/1.1 |
| 5,059,984 | 10/1991 | Moore et al. | 346/1.1 |
| 5,070,345 | 12/1991 | Lahut et al. | 346/1.1 |
| 5,075,689 | 12/1991 | Hoisington et al. | 346/1.1 |
| 5,079,563 | 1/1992 | Starkweather et al. | 347/41 |
| 5,079,571 | 1/1992 | Eriksen | 346/140 R |
| 5,170,416 | 12/1992 | Goetz et al. | 377/17 |
| 5,225,757 | 7/1993 | Burke | 318/696 |
| 5,239,312 | 8/1993 | Merna et al. | 346/1.1 |
| 5,422,666 | 6/1995 | Koyama | 347/41 |

OTHER PUBLICATIONS

A.L. Mix, "Interlace–Scan Arrays", *IBM Technical Disclosure Bulletin*, vol. 21, No. 10, Mar. 1979, pp. 3947–3948.

*Primary Examiner*—Benjamin R. Fuller
*Assistant Examiner*—David Yockey
*Attorney, Agent, or Firm*—Ralph D'Alessandro; Richard B. Preiss

[57] ABSTRACT

Improved color ink-jet printing is accomplished by an ink-jet nozzle array configuration (32, 110) which has an odd number of nozzles (34) that are uniformly spaced apart by two line widths (2 V) such that naturally interlaced printing is accomplished when a print head (54) employing the nozzle array configuration is moved in uniformly stepped intervals. A color ink-jet print head employing the array configuration further employs multiple horizontally spaced apart instances (30) of the array in which each array ejects a particular color of ink, and the nozzles of each array are aligned in the direction of scanning to eject ink toward a common band of lines. One printing method includes, following standard mode printing, moving the print medium one line width, disabling a first section of the nozzles, enabling a second section of the nozzles, shifting print data from the first section to the second section and printing closer to an edge of the print medium during a substantially last scan than would be possible without the disabling and shifting. Another printing method includes printing during four scans on even and odd numbered line sets in even and odd numbered pixel columns.

5 Claims, 13 Drawing Sheets

| LINE NO. | PASS 1 → | PASS 2 ← | PASS 3 → | PASS 4 ← |
|---|---|---|---|---|
| | NOZZLE NUMBER | | | |
| 1 | 1 o | | | |
| 2 | | | | |
| 3 | 2 o | | | |
| 4 | | | | |
| 5 | 3 o | | | |
| 6 | | | | |
| 7 | 4 o | | | |
| 8 | | | | |
| 9 | 5 o | | | |
| 10 | | | | |
| 11 | 6 o | | | |
| 12 | | | | |
| 13 | 7 o | | | |
| 14 | | | | |
| 15 | 8 o | | | |
| 16 | | | | |
| 17 | | 1 ● | | |
| 18 | 9 ● | | | |
| 19 | | 2 ● | | |
| 20 | 10 ● | | | |
| 21 | | 3 ● | | |
| 22 | 11 ● | | | |
| 23 | | 4 ● | | |
| 24 | 12 ● | | | |
| 25 | | 5 ● | | |
| 26 | 13 ● | | | |
| 27 | | 6 ● | | |
| 28 | 14 ● | | | |
| 29 | | 7 ● | | |
| 30 | 15 ● | | | |
| 31 | | 8 ● | | |
| 32 | 16 ● | | | |

TO FIG.2B

FIG.2A
(PRIOR ART)

| LINE NO. | PASS 1 → | PASS 2 ← | PASS 3 → | PASS 4 ← |
|---|---|---|---|---|
| | NOZZLE NUMBER | | | |
| 1 | 1 ○ | | | |
| 2 | | 1 ● | | |
| 3 | 2 ● | | | |
| 4 | | 2 ● | | |
| 5 | 3 ● | | | |
| 6 | | 3 ● | | |
| 7 | 4 ● | | | |
| 8 | | 4 ● | | |
| 9 | 5 ● | | | |
| 10 | | 5 ● | | |
| 11 | 6 ● | | | |
| 12 | | 6 ● | | |
| 13 | 7 ● | | | |
| 14 | | 7 ● | | |
| 15 | 8 ● | | | |
| 16 | | 8 ● | | |
| 17 | 9 ● | | | |
| 18 | | 9 ● | | |
| 19 | 10 ● | | | |
| 20 | | 10 ● | | |
| 21 | 11 ● | | | |
| 22 | | 11 ● | | |
| 23 | 12 ● | | | |
| 24 | | 12 ● | | |
| 25 | 13 ● | | | |
| 26 | | 13 ● | | |
| 27 | 14 ● | | | |
| 28 | | 14 ● | | |
| 29 | 15 ● | | | |
| 30 | | 15 ● | | |
| 31 | 16 ● | | 1 ○ | |
| 32 | | 16 ○ | | 1 ● |

TO FIG.4B

FIG.4A
(PRIOR ART)

INK-JET PRINT HEAD ARRAY AND INTERLACE METHOD

TECHNICAL FIELD

This invention relates to color ink-jet printing in which a color image is formed by printing repeated sets of lines with one or more colors of ink ejected by a print head scanning a print medium and in particular to interlaced color printing apparatus and methods employing linear arrays of ink-jet nozzles in which each nozzle array prints a particular color and has an odd number of nozzles.

BACKGROUND OF THE INVENTION

This invention is suited for use in ink-jet printers in which a print head scans over a print medium, such as a sheet of paper or transparent film, by shuttling bidirectionally across the print medium or by moving continuously along the print medium in one direction while the print medium is supported against a rotating drum. Printed images are formed by selectively depositing ink drops of primary or base colors at uniformly spaced address locations disposed in uniformly spaced rows to form a dot-matrix image. Variations in color may be achieved by depositing ink drops at the address locations by using well-known dithering or gray-scale techniques.

This invention is equally applicable to any printing process in which a print head travels along parallel lines relative to a print medium to form a desired image, whether the image is primarily graphic or textual. The term "printing" includes a general situation in which a print element or nozzle addresses an ink drop location, without regard to whether ink is actually deposited. Moreover, in the general situation the size of the drop may vary and even the number of drops of a given color that are deposited at a particular address location may vary.

Skilled workers recognize that printing speed may be improved by printing more than one line at a time by ejecting ink drops from multiple nozzles that are configured in a linear array such that a band of lines are printed during each scan. Such printing is referred to as band printing.

In color band printing, it is desirable that ink-jet arrays for ejecting different colors be spaced apart in the direction of print medium movement so that each color dries or sets before the next color is deposited. With this configuration, multiple spaced apart bands of colors are deposited in the same sequence for both directions of print head scanning relative to the print medium. However, print heads having such an array configuration have a relatively large dimension in the direction of paper movement, thereby limiting their usefulness to printing on relatively flat print media. Such a configuration can also limit how close to an edge of a print medium printing can be achieved.

Because it is common to support print media on a drum, ink-jet arrays are commonly spaced apart in the direction of scanning to reduce the print head dimension in the direction of media movement. In this case, multiple bands of colors are deposited one on top of the another during each scan of the print head, with an ink color laydown sequence being dependent on the direction of scanning.

Both configurations have advantages and disadvantages that are related to a variety of printing variables as described in more detail below.

Prints generated by some color ink-jet printers exhibit noticeable streaks parallel to the print head scanning direction in areas printed with solid color fill. The streaks can be either higher or lower in optical density than the surrounding area, and they occur where a band of color printed during one scan abuts a band of color printed during a subsequent scan. Streaks may be caused by mechanical positioning errors in paper-advance mechanisms or ink bleeding between bands. To minimize streaks, the bands of color should be interlaced rather than abutted.

Color band interlacing refers to the partial overlapping of a first printed band of a color with a subsequent printed band of the same color. This also requires line interlacing and results in the spacing apart of any printing defects due, for example, to a defective ink-jet in an array of ink-jets.

Line interlacing entails printing adjacent lines of dots of a particular color during sequential scans of the print head. For example, lines 1, 3, 5, etc., are printed during a first scan, and lines 2, 4, 6, etc., are printed during the next scan. In a high-speed printer, it is desirable to print during both scanning directions. With line interlacing, any printing errors and related image defects that are dependent on the scanning direction are generated at a spatial frequency that is the inverse of the spacing between lines.

Streaks and banding effects can also be caused by the type of ink ejected by a print head, such as water-based inks, oil-based inks, and phase-change or thermoplastic inks. Phase-change inks are preferred, because of their color intensity, "drying" characteristics, and compatibility with many types of print media including plain paper.

Phase-change inks, are typically supplied to a printer in solid forms such as sticks or granules, are melted by a heater, and ejected toward the print medium by the print head as hot liquid ink droplets. When the hot ink droplets strike the print medium they cool, changing state back to a solid form (setting), and bonding to the print medium in the process.

U.S. Pat. No. 5,075,689 issued Dec. 24, 1991 for BIDIRECTIONAL HOT MELT INK JET PRINTING describes a phase-change ink-jet printer in which printed color hue is dependent on the order in which inks are deposited one on top of the other. If a first colored ink drop is deposited and a second colored ink drop is deposited on top of the first drop, a particular color is created. But if the ink color laydown sequence is reversed, a slightly different color is created. The patent proposes depositing both drops in such a short time period that they remain in a liquid state that allows their colors to mix together prior to setting. However, this solution is not satisfactory for all phase-change inks, especially those having high chromaticity. Moreover, because pairs of liquid drops that mix together form a larger resultant drop than that in which the second drop is deposited on top of a set drop, color hue shift effects are still noticeable.

Therefore, it is known that the ink color laydown sequence is important and, as described above, depends on scanning direction in some print head array configurations, ink composition, and time between depositing successive drops.

Ideally, to reduce hue-related printing artifacts, ink laydown sequences should always be the same regardless of scan direction. If this is not possible, an alternative is to alternate the ink laydown sequences on adjacent lines so that the hue variations will have a high spatial frequency that is not easily perceived by the human eye.

It is desirable, therefore, to provide line and band interlacing of each of the colors and a constant color laydown sequence when printing bidirectionally. As described above, a dimensional limitation is often imposed on the height of ink-jet nozzle array configurations. There are also print head manufacturing limitations to the closeness of nozzle and array spacing. Skilled workers might conclude that an ideal print head would have nozzles and arrays spaced closely together and provide the desired print interlacing. Another worker might require the arrays to be widely separated in the scanning direction to allow a first drop to set before a subsequent drop of a different color is deposited over the first drop.

Because of the wide variety of nozzle array configurations, ink types, print media supports, print head and media movement mechanisms, and the like, a corresponding variety of print interlacing methods and print head nozzle array patterns are known in the art.

For example, U.S. Pat. No. 5,070,345 issued Dec. 3, 1991 for INTERLACED INK JET PRINTING characterizes many of the banding and seaming problems associated with phase-change ink-jet printing and describes guidelines for minimizing those problems. The guidelines state that banding can be minimized if adjacent dot rows are not printed during the same pass, and each dot row should be deposited between either unprinted adjacent dot rows or deposited between adjacent printed dot rows. Thereby, printing artifacts caused by ink blending and thermal unbalance problems are minimized. Nozzle array configurations and printing methods are described with reference to FIGS. 1–4 that conform to the guidelines.

FIG. 1 shows a first nozzle array configuration 10 that is split into two 8-nozzle subsections 12 and 14. Nozzles 16 in each subsection are spaced apart vertically by two line widths 2 V, and subsections 12 and 14 are spaced apart vertically by three line widths 3 V.

FIGS. 2A–2B show a printing method suitable for use with first nozzle array configuration 10. An even number, in this case 16, of nozzles spans 32 lines. The printing method proceeds as follows:

During a first pass in a first direction, nozzles 1–18 are disabled and nozzles 9–16 are enabled for printing even-numbered lines 18–32. Enabled nozzles are shown as darkened circles, and disabled nozzles are shown as open circles.

Array 10 is stepped down 16 lines relative to the print medium.

During a second pass in a second direction, nozzles 1–8 are enabled for printing odd-numbered lines 17–31 and nozzles 9–16 are enabled for printing even-numbered lines 34–48.

Array 10 is stepped down another 16 lines relative to the print medium.

During a third pass in the first direction, nozzles 1–8 are enabled for printing odd-numbered lines 33–47 and nozzles 9–16 are enabled for printing even-numbered lines 50–64.

Array 10 is stepped down another 16 lines relative to the print medium, and the process is repeated as required.

Advantages associated with array 10 and its printing method include uniform 16—16—16 line print head stepping, full nozzle utilization, and uniform interlacing. Disadvantages include print head manufacturing difficulties and print head positioning restrictions related to array subsection spacing 3 V.

To overcome the above-described disadvantages, FIG. 3 shows a second nozzle array configuration 20 in which all 16 of nozzles 16 are spaced apart vertically by two line widths 2 V to form a linear array. Note that in nozzle array configurations 10 and 20, nozzles 16 are spaced apart horizontally by a distance H that is typically an integer multiple of the dot spacing in a scan line. Distance H is usually made as small as possible to facilitate print head manufacturability while still maintaining vertical spacing 2 V between nozzles 16.

FIGS. 4A–4B show a printing method suitable for use with second nozzle array configuration 20. Again, an even number of nozzles 16 is employed. However, for nozzle array configuration 20, nozzles 16 span 31 lines. The printing method proceeds as follows:

During a first pass in a first direction, nozzle 1 is disabled and nozzles 2–16 are enabled for printing odd-numbered lines 3–31.

Array 20 is stepped down one line relative to the print medium.

During a second pass in a second direction, nozzle 16 is disabled and nozzles 1–15 are enabled for printing even-numbered lines 2–30.

Array 20 is stepped down 29 lines relative to the print medium.

During a third pass in the first direction, nozzle 1 is disabled and nozzles 2–16 are enabled for printing odd-numbered lines 33–61.

Array 10 is stepped down another one line relative to the print medium, and the process is repeated as required.

Advantages associated with array 20 and its printing method include print head manufacturability and no stepping restrictions. Disadvantages include nonuniform 1-29—1-29 line print head stepping, incomplete nozzle utilization, nonuniform line interlacing, and no band interlacing. The uneven print head stepping can cause uneven mechanical positioning and thermal imbalances that cause banding.

Color ink-jet printing is discussed in U.S. Pat. No. 5,079,571 issued Jan. 7, 1992 for INTERLACED PRINTING USING SPACED PRINT ARRAYS, assigned to the assignee of this application, which describes the utilization of uniform linear arrays, each having an even number of nozzles. Each array is configured for color interleaving such that no two colors are printed on the same line during the same scan. Ink laydown order and color blending problems are thereby minimized. However, the print head internal architecture is complex and nonuniform, leading to ink purging, crosstalk, manufacturability, and banding problems. Moreover, performance is limited because the arrays are spread vertically, placing a limit on the number of nozzles in each array.

Despite many prior attempts, banding, seaming, and streaking problems persist in color ink-jet printing. Moreover, the problems seem more pronounced in high-performance, readily manufacturable print heads having arrays with large numbers of nozzles.

What is needed, therefore, are color ink-jet printing methods and nozzle array configurations that minimize color printing artifacts when used with high-performance print heads that have multiple nozzle arrays, each having a large number of nozzles.

SUMMARY OF THE INVENTION

An object of this invention is, therefore, to provide an improved color ink-jet nozzle array configuration suitable for high-performance color printing with a minimum of printing artifacts.

Another object of this invention is to provide improved printing methods for use with the improved nozzle array configuration such that printing artifacts are further reduced.

Yet another object of this invention is to provide a printing method that allows printing closer to the edge of a print medium.

Accordingly, this invention provides an ink-jet nozzle array configuration having an odd number of nozzles that are uniformly spaced apart by two lines such that naturally interlaced printing is accomplished when the print head is moved in substantially uniform intervals. A color ink-jet print head employing the array configuration further employs multiple horizontally spaced apart instances of the array, in which each array ejects a particular color of ink and the nozzles of each array are aligned in the direction of scanning to eject ink toward a common band of lines.

A printing method is provided for use with the color ink-jet print head array configuration, which provides uniformly stepped band and line interlacing. Another printing method provides intra-line interlacing modes that further reduce printing artifacts by separating deposited ink drops in space and in time so that interlacing and ink laydown sequences are uniformly maintained. Yet another printing method is provided whereby printing is accomplished closer to an edge of a print medium than would ordinarily be possible with many prior interlaced band printing nozzle array configurations and methods.

Additional objects and advantages of this invention will be apparent from the following detailed description of preferred embodiments thereof that proceeds with reference to the accompanying drawings.

BRIEF DESCRIPTION OF THE DRAWINGS

FIGS. 2A–2B are a table pictorially showing a prior art interlaced printing method employing the ink-jet nozzle array configuration shown in FIG. 1.

FIGS. 4A–4B are a table pictorially showing a prior art interlaced printing method employing the ink-jet nozzle array configuration shown in FIG. 3.

DETAILED DESCRIPTION OF PREFERRED EMBODIMENTS

Figure 1:
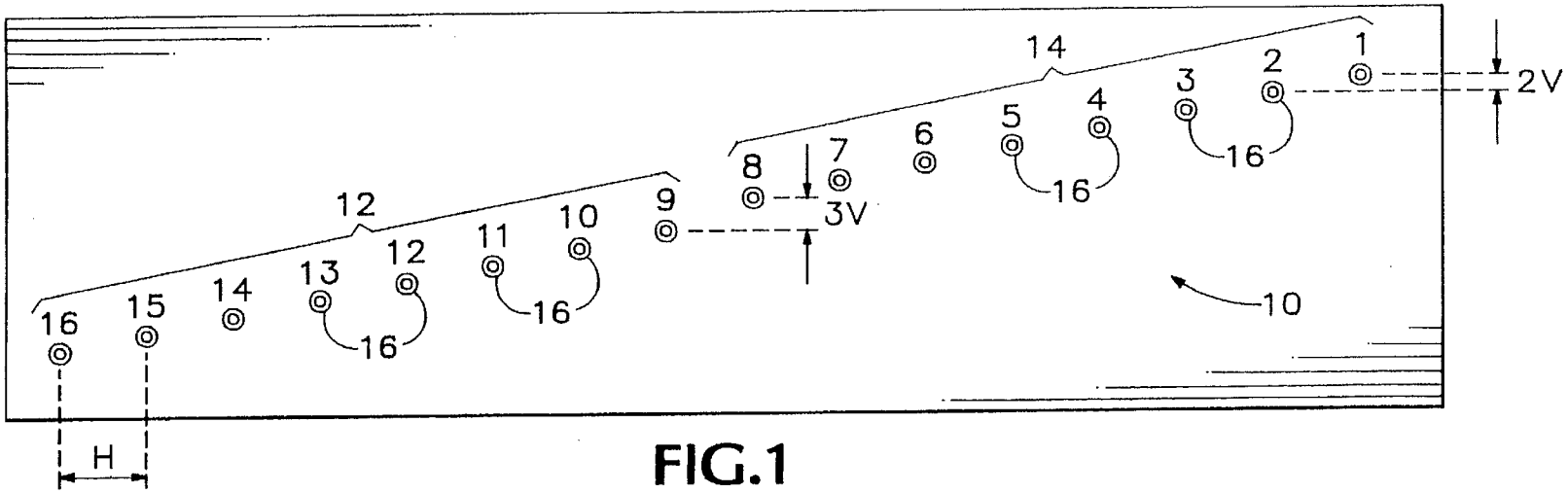
FIG.1 (PRIOR ART)
FIG. 1 is a frontal plan view of a prior art ink-jet print head showing a 16-nozzle array configuration in which each nozzle array is split into two 8-nozzle subsections and in which the nozzles are spaced apart vertically by two line widths and the subsections are spaced apart vertically by three line widths.
Figure 3:
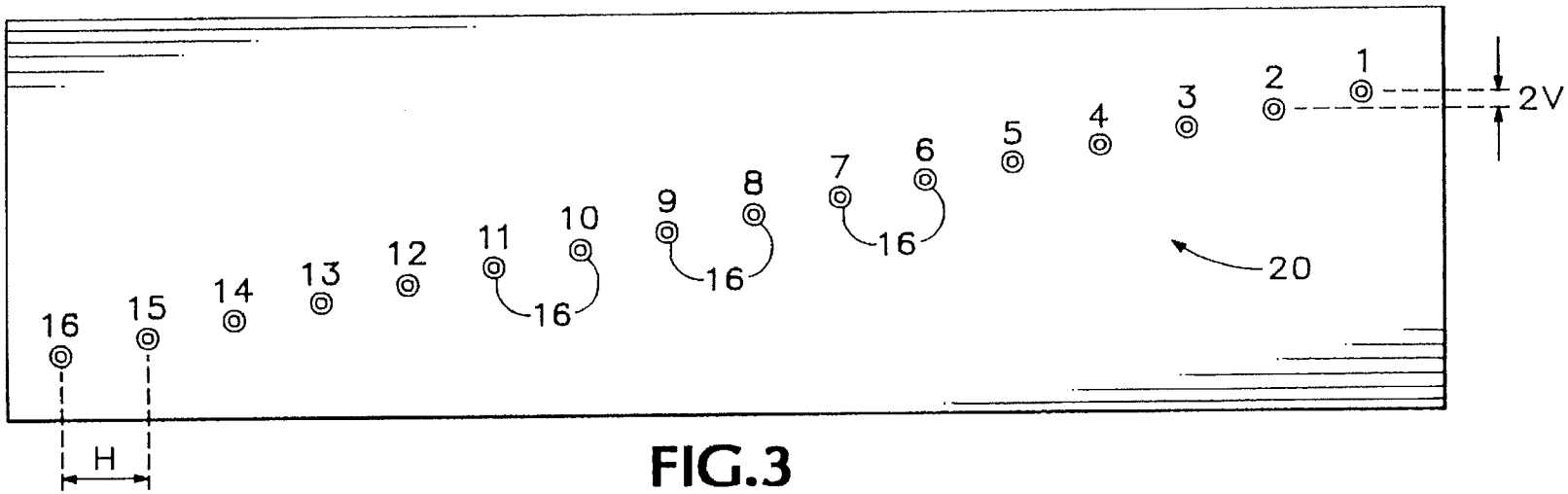
FIG.3 (PRIOR ART)
FIG. 3 is a frontal plan view of a prior art ink-jet print head showing a 16-nozzle array configuration in which each of the nozzles is spaced apart vertically by two line widths.
Figure 2B:
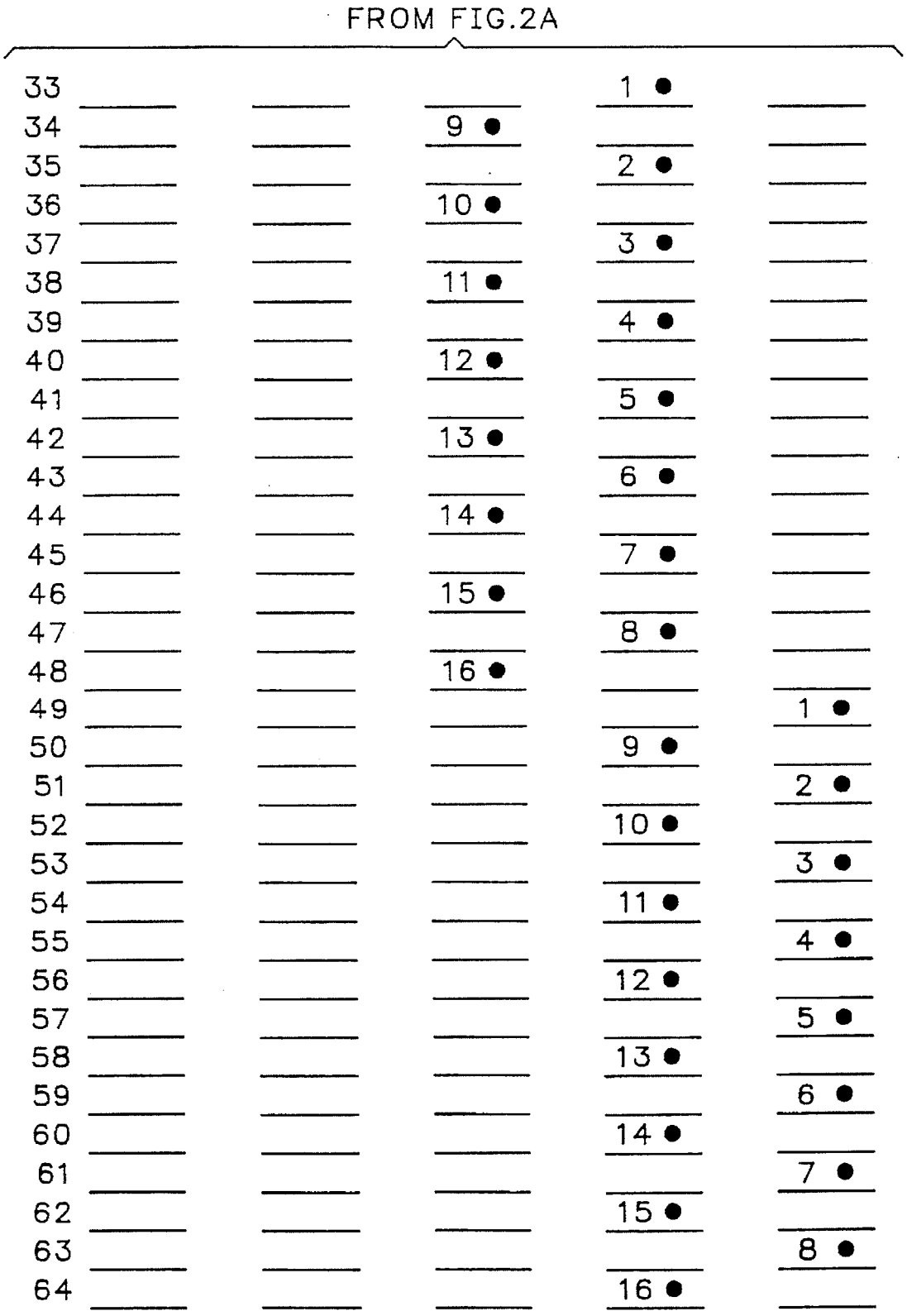
FIG.2B (PRIOR ART)
Figure 4B:
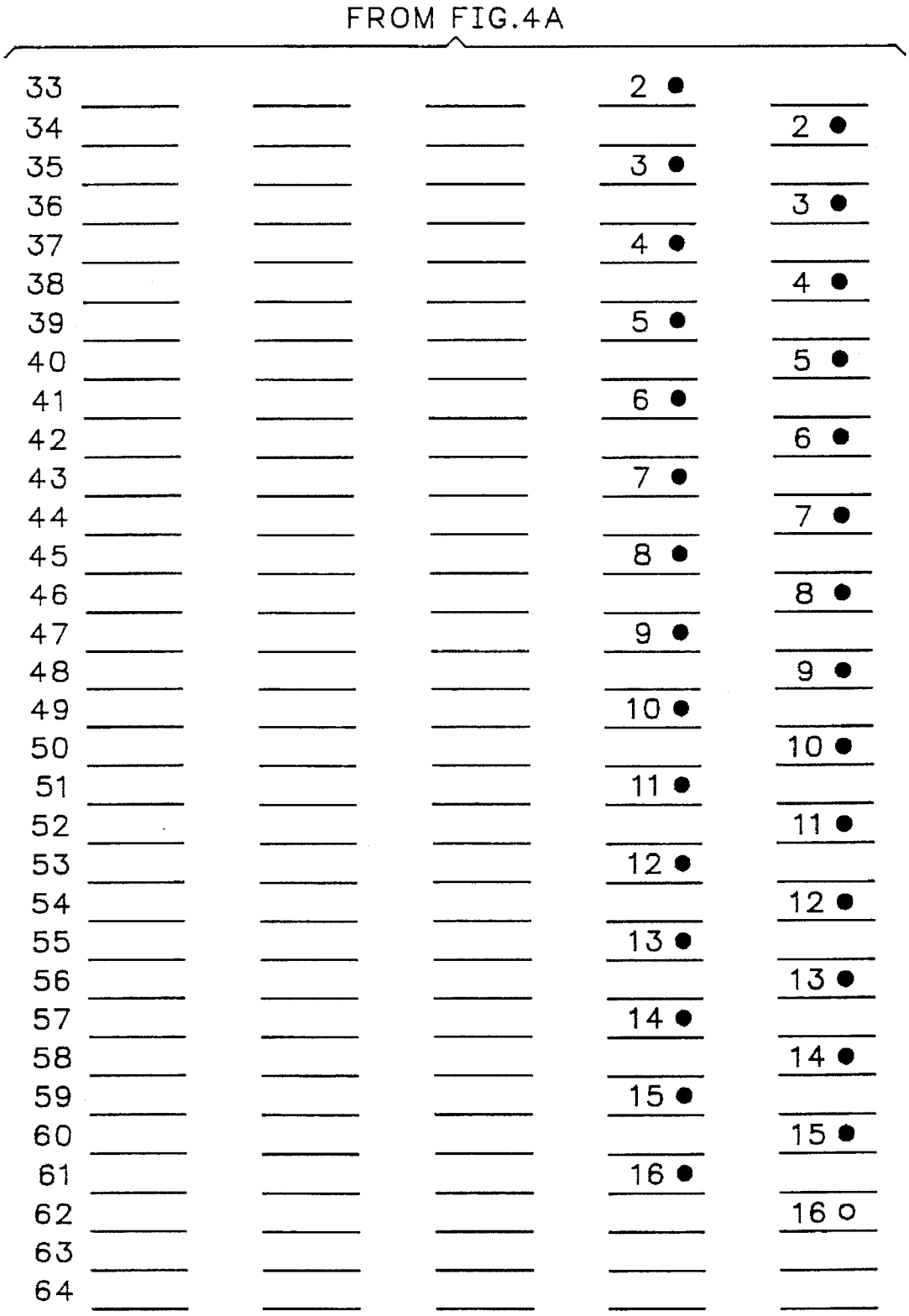
FIG.4B (PRIOR ART)
Figure 5A:
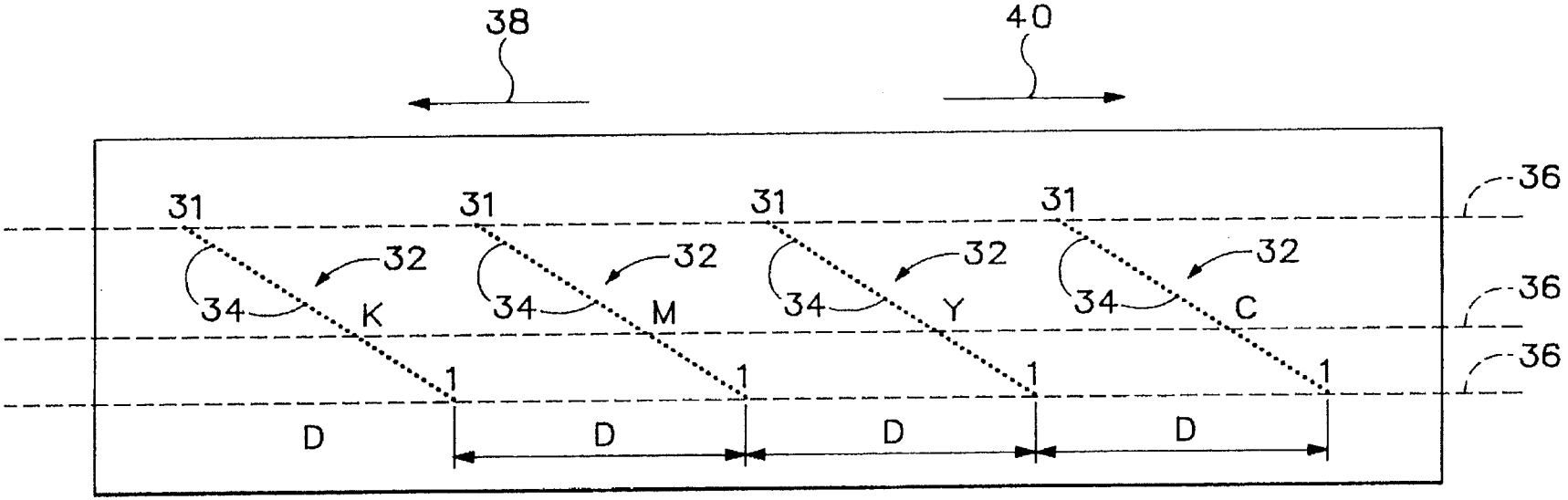
FIG. 5A is a simplified frontal plan view of a preferred color ink-jet print head nozzle array configuration according to this invention showing four 31-nozzle arrays in which the nozzles in each array is spaced apart vertically by two line widths and each of the arrays are spaced apart horizontally such that corresponding nozzles in each array print on the same lines.
Figure 5B:
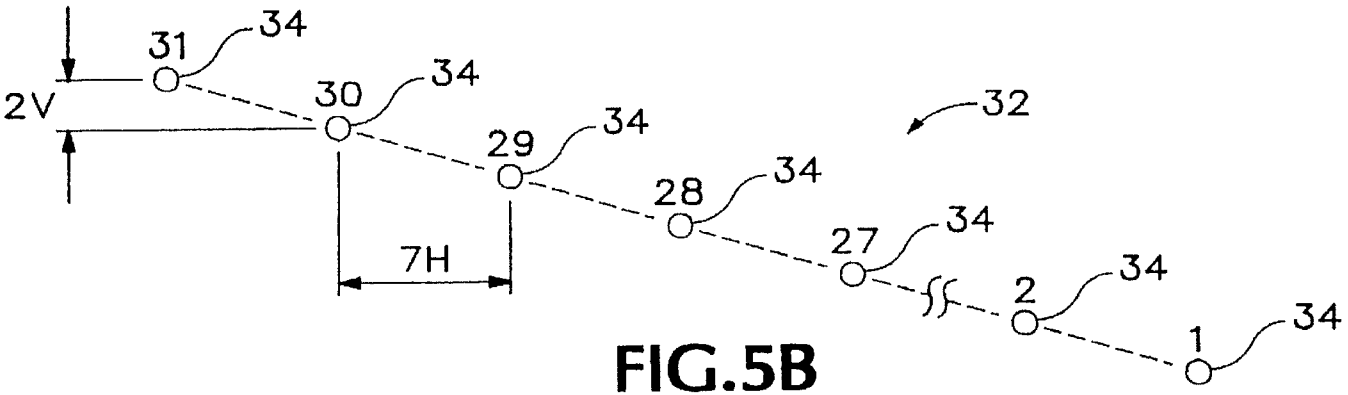
FIG. 5B is an enlarged frontal plan view representative of one of the nozzle arrays of FIG. 5A showing the preferred nozzle-to-nozzle spacings.

FIGS. 5A and 5B show a preferred color ink-jet print head nozzle array configuration 30 having four substantially identical nozzle arrays 32 each having an odd number of nozzles 34 that are spaced apart vertically by a distance 2 V of about two pixel diameters and that are spaced apart horizontally by a distance 7 H of about seven pixel diameters. Nozzle arrays 32 preferably each have 31 of nozzles 34 numbered from 1 to 31 as shown in FIG. 5A. Of course, the terms "horizontal" and "vertical" are used only in a general sense to portray a pair of substantially orthogonal directions. Directions and dimensions employed by this invention may employ virtually any mutually orthogonal set of coordinates or orientations.

With that in mind, each of nozzle arrays 32 is spaced apart horizontally a distance D of about 22 millimeters. Corresponding nozzles 34 in each array 32 are horizontally aligned to print on the same printing lines 36. Nozzle array configuration 30 is, therefore, of a type that changes the ink color laydown sequence if bidirectionally scanned in directions indicated by arrows 38 and 40. The preferred ink colors and laydown sequence for scanning in direction 40 are cyan ("C"), yellow ("Y"), magenta ("M"), and black ("K").

Construction details for an ink-jet print head having preferred nozzle array configuration 30 are described in copending U.S. patent application Ser. No. 08/056,346 now U. S. Pat. No. 5,455,615 filed Apr. 30, 1993 for A MULTIPLE-ORIFICE DROP-ON-DEMAND INK JET PRINT HEAD HAVING IMPROVED PURGING AND JETTING PERFORMANCE, which is assigned to the assignee of this application and incorporated herein by reference.

Figure 6:
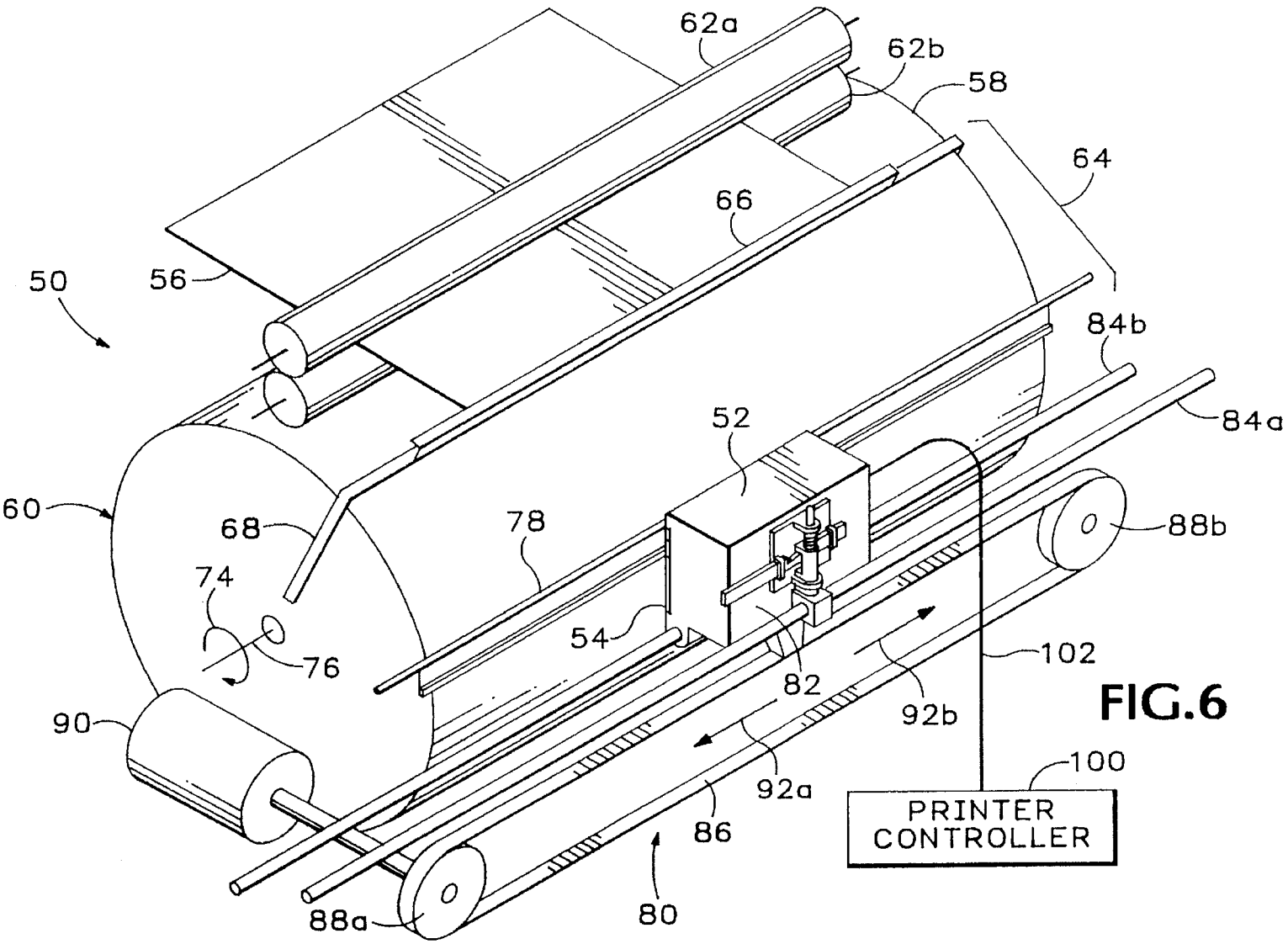
FIG. 6 is a simplified isometric pictorial view of a preferred ink-jet printer suitable for use with this invention showing the arrangement of its major subassemblies.

FIG. 6 shows a preferred high-resolution, full-color ink-jet computer printer 50 having an ink-jet print head assembly 52 that supports an ink-jet print head 54 having nozzle array configuration 30 (FIG. 5A). Printer 50 is of a type such as the model Phaser-300 manufactured by the assignee of this application. Print head 54 ejects ink droplets toward a print medium 56 such as a sheet of plain paper. Printer 50 is capable of printing on a variety of print media types including transparent films and labels.

Print medium 56 is supported on an outer surface 58 of a media support drum 60. Print medium 56 is fed through a pair of media feed rollers 62A and 62B and secured to surface 58 by a media securing system 64. Media securing system 64 includes a media clamp 66 that receives and clamps the side margin of a leading end of print medium 56 against drum 60. Media clamp 66 slides into and remains stationary within a slot 68 in drum 60.

A drum rotating motor (not shown) rotates drum 60 incrementally in a direction 74 about an axis 76 extending through the center and along the length of drum 60, thereby pulling print medium 56 through media feed rollers 62A and 62B and under a back tension blade 78 that is held under tension against surface 58 by a spring (not shown). Print medium 56 slides under and is held against surface 58 by back tension blade 78 as drum 60 rotates. A suitable mechanism for rotating drum 60 in uniform increments is described in U.S. Pat. No. 5,225,757 issued Jul. 6, 1993 for a METHOD FOR DERIVING AND IMPLEMENTING MOTION PROFILES FOR DRIVE SYSTEMS, which is assigned to the assignee of this application and incorporated herein by reference.

A print head positioning system 80 includes a carriage 82 slidably mounted on a pair of spaced apart, parallel guide rails 84A and 84B and supporting print head assembly 52. A carriage drive belt 86 is attached to carriage 82 and held under tension by a pair of spaced apart belt pulleys 88A and 88B. A carriage motor 90 linked to pulley 88A drives carriage 82 in directions 92A and 92B along guide rails 84A and 84B.

To print text or graphics images on print medium 56, the drum motor rotates drum 60 about axis 76 in incremental angular steps and carriage motor 90 drives carriage 82 along guide rails 84A and 84B. A printer controller 100 delivers print control signals to a control input 102 of print head 54. A suitable printer controller is described in U.S. Pat. No. 4,978,971 issued Dec. 18, 1990 for a METHOD AND APPARATUS FOR REFORMATTING PRINT DATA, which is assigned to the assignee of this application and incorporated herein by reference.

In response to the print control signals, print head 54 ejects ink droplets directed toward print medium 56 supported on surface 58 of drum 60. The ink is preferably of a hot melt type that is contained in and heated by an ink supply chamber and an ink reservoir contained within print head assembly 52.

The print control signals are delivered to print head 54 while carriage 82 is driven in alternate directions 92A and 92B, thereby providing boustrophedon or bidirectional printing in which successive image lines are printed alternately in directions 92A and 92B.

Referring again to FIG. 5B, nozzle array 32 has each of nozzles 34 spaced vertically apart by two pixel widths 2 V to provide interlaced printing, thereby ensuring that ink drops ejected during any one scan will not be printed next to each other. In actual operation, interlacing is not perfect for secondary colors that require overlaying more than one color of ink because surface irregularities in the print media and ink drop vertical positioning variations often cause ink bridges between lines spaced two pixels apart.

Bidirectional print quality is also susceptible to horizontal drop positioning errors referred to as misconvergence. Misconvergence occurs when ink drops intended for the same vertical position on a print medium are ejected during opposite directional scans of a print head at imprecisely timed intervals. The precise time interval is a variable that depends on many factors including ink drop ejection velocity, print head velocity, distance from an ejecting nozzle to the print medium, and positioning accuracy of print head positioning system 80. A print head positioning system suitable for use with this invention is described in U.S. Pat. No. 5,170,416 issued Dec. 8, 1992 for an ENCODER DUTY-CYCLE ERROR CORRECTOR, which is assigned to the assignee of this application and incorporated herein by reference.

The above-described ink-jet printing problems are minimized by nozzle array configuration 30 together with the below-described ink-jet printing modes, which provide improved ink-jet printing quality. The printing modes all conform to a guideline which states that neighboring ink drops should be separated from one another spatially or in time until set or solidified.

The printing modes are described below with reference to FIG. 6 and other figures and tables as specified.

In a standard printing mode in which print head 54 utilizes nozzle array configuration 30, media support drum 58 steps 31 line positions between bidirectional scans, creating print bands each having a 2.62-millimeter (0.103-inch) width. Because the 31 nozzles of arrays 32 are spaced apart two line distances, scans in a first direction print all even- or odd-numbered lines, and because drum 58 steps an odd number of lines between scans, scans in the second direction print on the opposite numbered lines, creating a natural interlace.

Figure 7A:
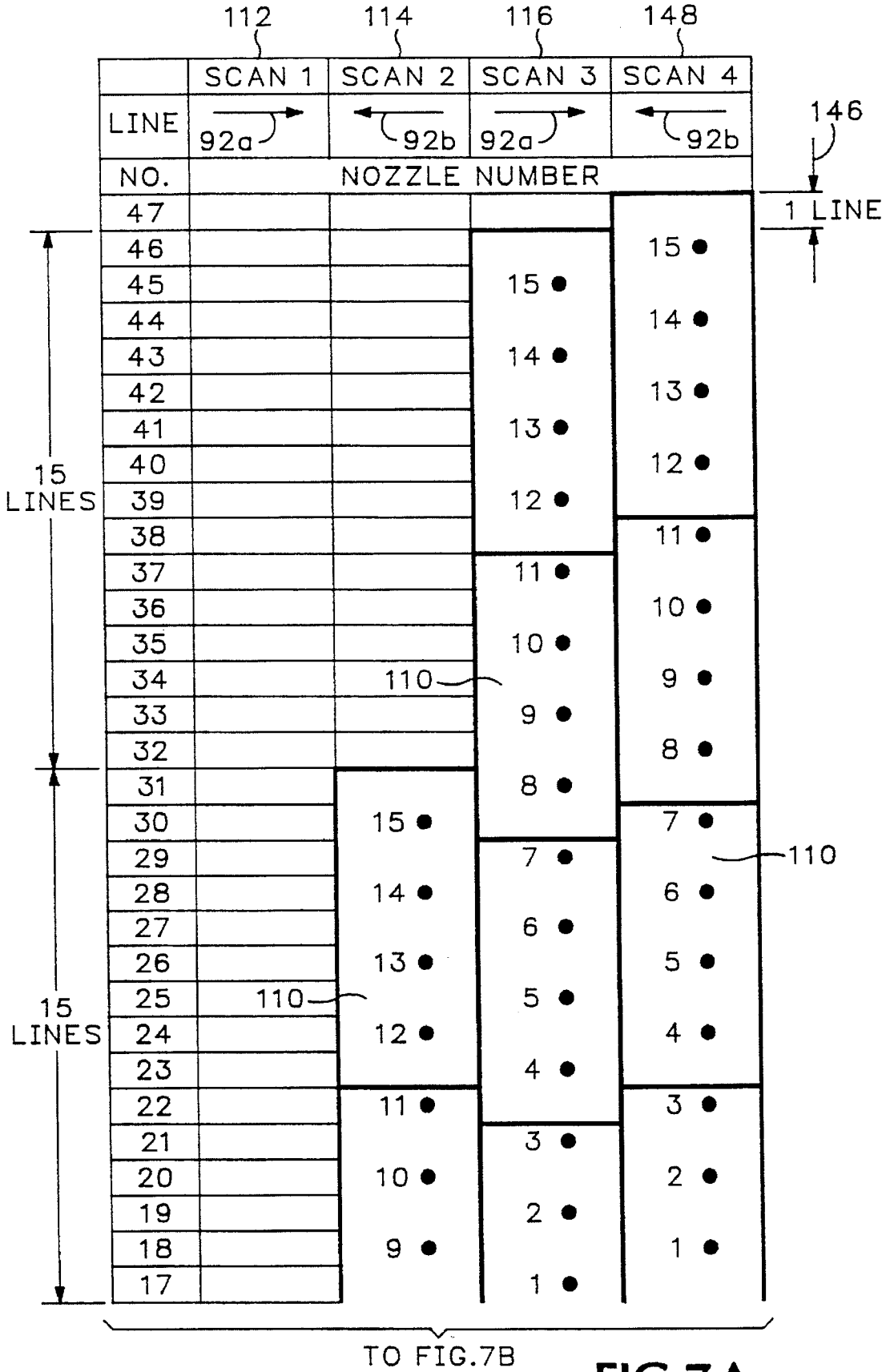
FIGS. 7A–7B are a table illustrating an improved interlaced printing mode employing a print head nozzle array having an odd number of nozzles and a uniform number of print medium positioning steps between printing scans.
Figure 7B:
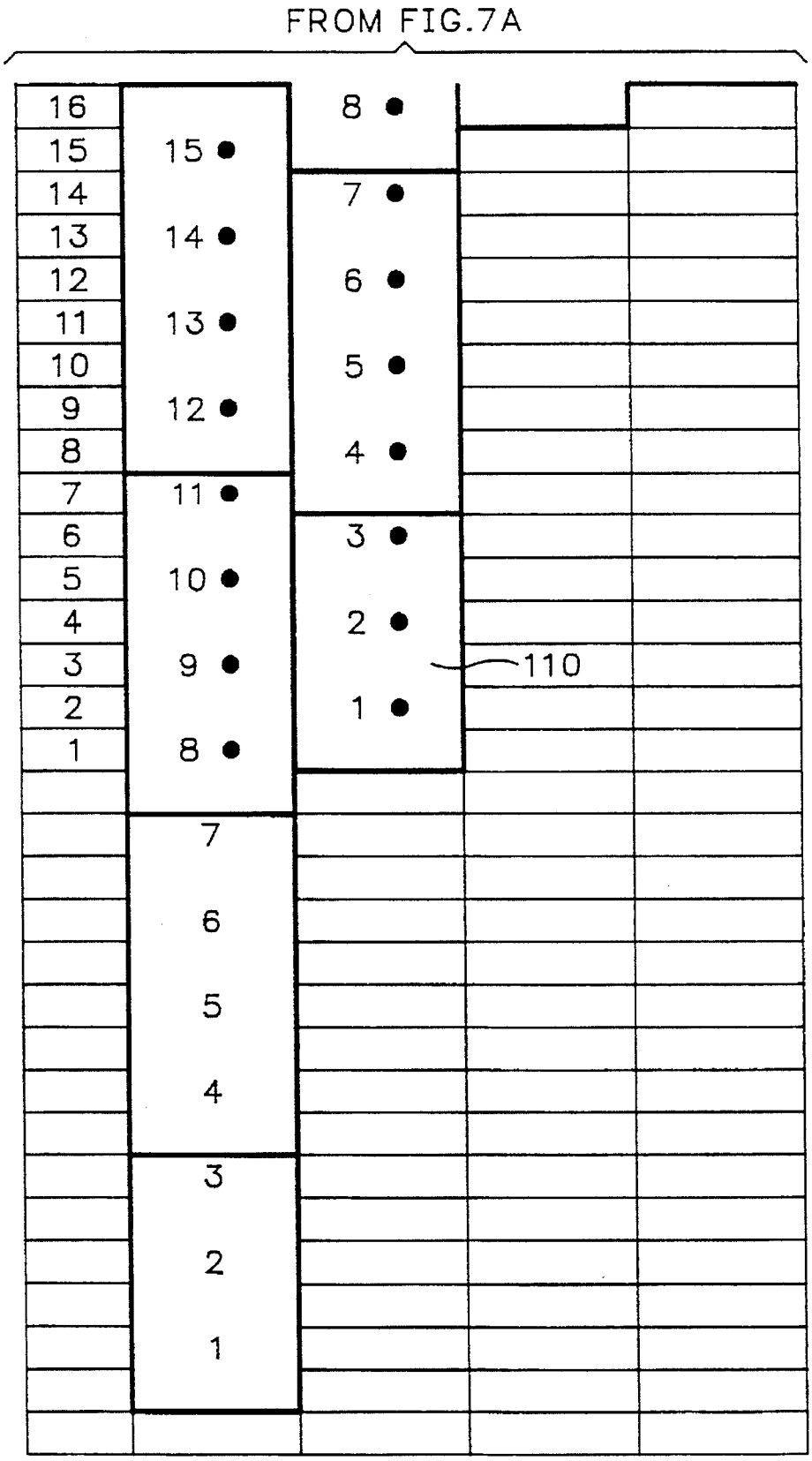

FIGS. 7A–7B illustrate how the standard printing mode operates in conjunction with an odd-numbered nozzle array configuration such as nozzle array configuration 32 (FIG. 5B). In this example, however, a 15-nozzle array configuration 110 is shown to clarify the description. The standard mode is operable with any odd-numbered nozzle array with 31 nozzles being preferred. Also note that printer 50 is of a type that prints upside down. Therefore, line and nozzle numbers are hereafter shown in descending order. Nozzle numbers enabled for printing are shown in bold type with a darkened circle following the nozzle number. Disabled nozzle numbers are shown in plain type without the darkened circle. The standard printing mode operates as follows:

During a first scan 112 in first direction 92A, nozzles 1–7 are disabled and nozzles 8–15 are enabled for printing odd-numbered lines 1–15.

Array 110 is stepped down 15 lines relative to the print medium.

During a second scan 114 in second direction 92B, nozzles 1–15 are enabled for printing even-numbered lines 2–30.

Array 110 is stepped down 15 lines relative to the print medium.

During a third scan 116 in first direction 92A, nozzles 1–15 remain enabled for printing odd-numbered lines 17–45.

Array 110 is stepped down another 15 lines relative to the print medium (unless a bottom edge of the print medium is encountered), and the process is repeated as required.

In the standard printing mode, the ink color laydown sequence for secondary colors changes from scan to scan or line to line. If one line is printed primary 2 on top of primary 1, the adjacent lines are printed primary 1 on top of primary 2. However, the ink laydown sequence occurs at a high spatial frequency (5.9 drops per millimeter) and is not easily discernable to the human eye if the printed lines are of equal width and less than one pixel wide.

In operation the printed lines are often more than one pixel wide, which causes a color shift from band to band, a problem that is most visible when printing blue. Therefore, enhanced printing modes were developed to minimize such banding.

Figure 8A:
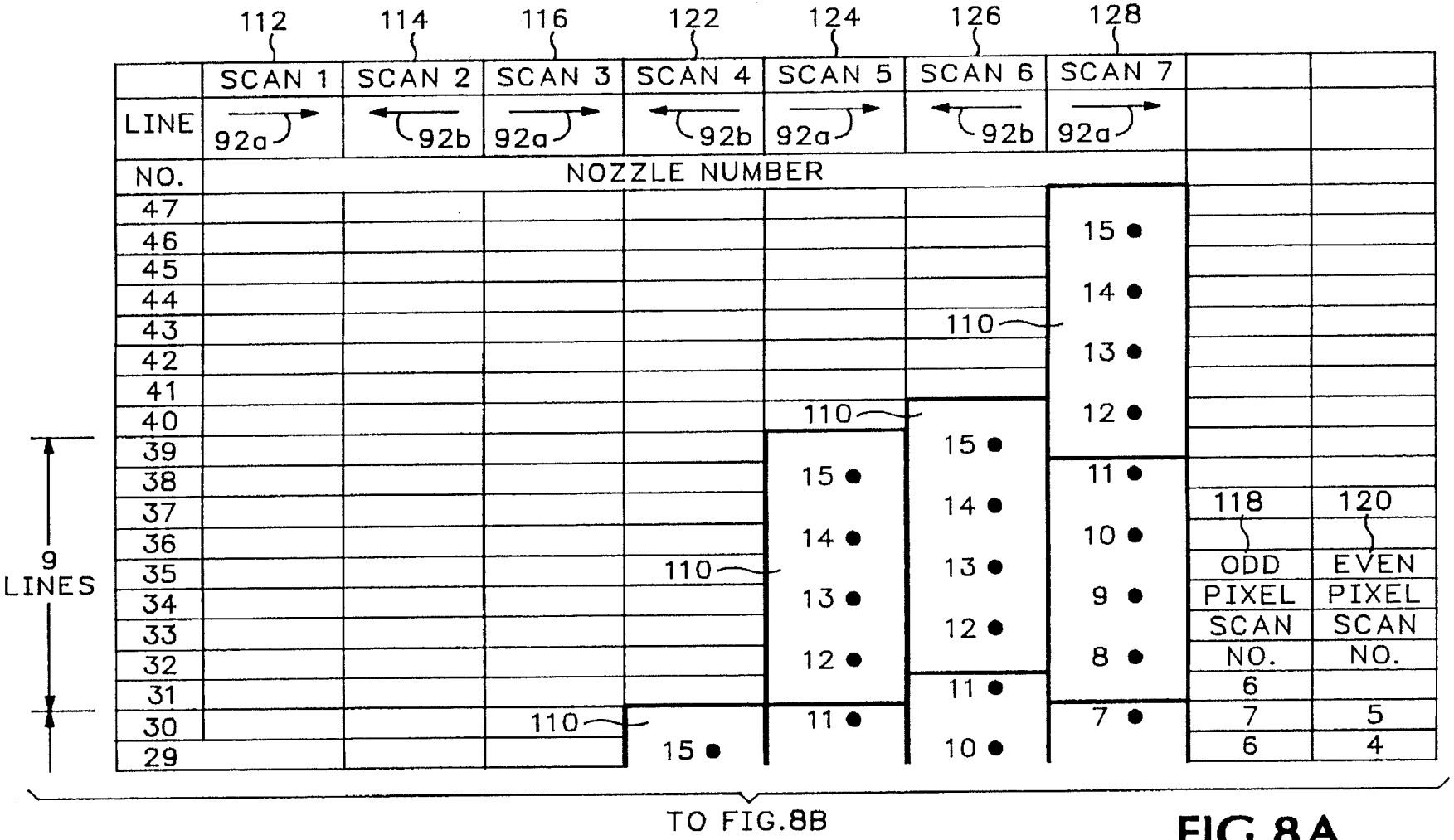
FIGS. 8A–8C are a table illustrating a further improved interlaced printing mode employing a print head nozzle array having an odd number of nozzles and a substantially uniform number of print medium positioning steps between printing scans.
Figure 8B:
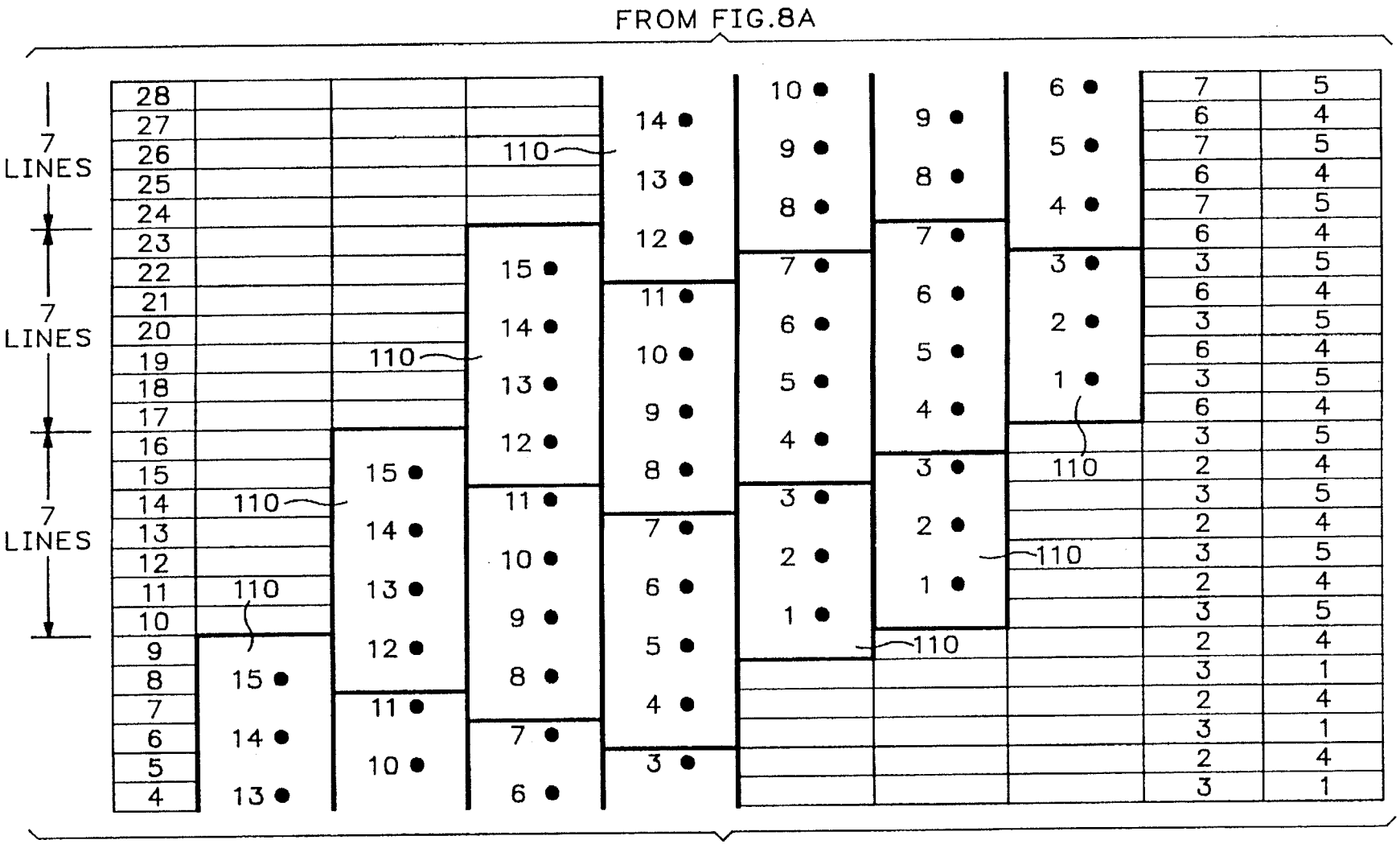
Figure 8C:
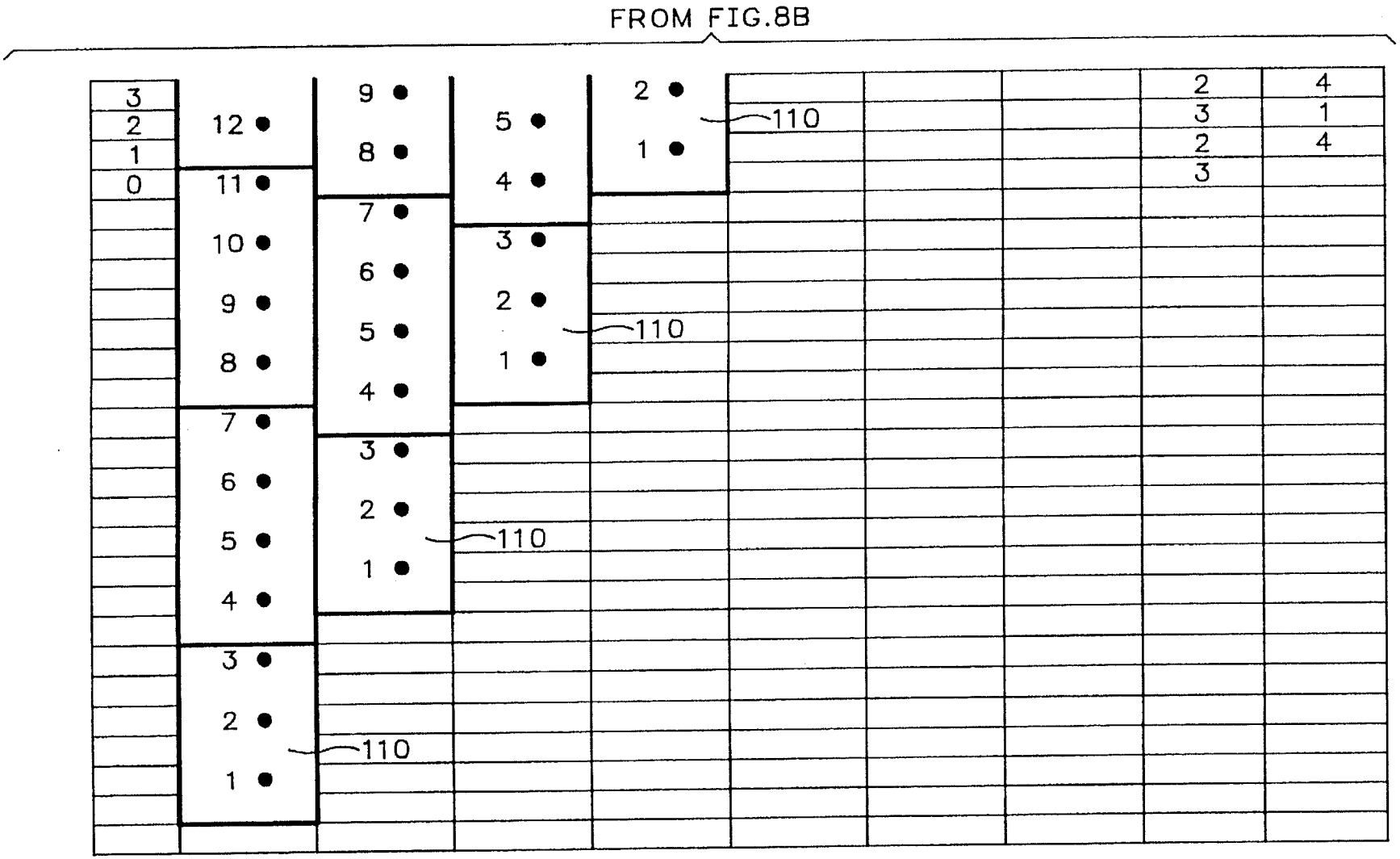

FIGS. 8A–8C illustrate how enhanced printing modes operate in conjunction with an odd-numbered nozzle array configuration such as nozzle array configuration 32 (FIG. 5B). In this example, as for standard mode, 15-nozzle array configuration 110 is shown to clarify the description.

In a set of bidirectional enhanced printing modes, every other pixel position (odd pixels 118 or even pixels 120) is enabled during each scan for printing in alternate scanning directions. Because every other line is addressed during each scan, at least four scans are required to fill an image area with ink. The number of lines stepped by drum 58 may vary from scan to scan, but the total number of lines printed during four sequential scans must equal the total number of lines spanned by array 110, in this example 2 multiplied by 15 lines equals 30 lines.

For drum 58 and 31-nozzle array 32 shown in FIG. 5B, three of many possible enhanced printing modes are listed below in Table 1.

TABLE 1

| Drum Stepping Sequences | Lines Printed | Pixel Enabling Even | Pixel Enabling Odd |
|---|---|---|---|
| Mode 1 stepping: 15-16-15-16 | Even lines | 1 | 4 |
| | Odd lines | 3 | 2 |
| Mode 2 stepping: 15-15-15-17 | Even lines | 1 | 3 |
| | Odd lines | 4 | 2 |
| Mode 3 stepping: 1-30-1-30 | Even lines | 1 | 4 |
| | Odd lines | 3 | 2 |

Enhanced mode 1 is advantageous because pixels in the same vertical column are always printed in the same scan direction, which results in well-converged vertical lines and good text quality.

Enhanced mode 2, also shown in FIG. 8, is advantageous because all pixels in the same line are printed in the same scan direction to avoid misconvergence, which results in good solid fill quality.

Enhanced modes 1 and 2 have a disadvantage because pixels are sequentially printed in a two-by-two pixel square "checkerboard" pattern that is sometimes visible from band to band under certain lighting conditions.

Enhanced mode 3 avoids the checkerboard pattern problem of modes 1 and 2 by making the width of alternate bands so small that the whole surface is effectively printed in the same way. However, enhanced mode 3 is not preferred because the nonuniform 1-30-1-30 stepping of drum 58 reduces printing performance and causes a mechanically induced type of banding problem.

Enhanced mode 2 is, therefore, the preferred enhanced printing mode. FIG. 8 shows which pixels, odd pixels 118 or even pixels 120, are printed during each of seven sequential mode 2 scans 112, 114, 116, 122, 124, 126, and 128.

This invention also provides premium printing modes that further improve print quality by combining unidirectional printing with the above-described standard and enhanced printing modes. Ink drop convergence problems are thereby eliminated. The preferred premium mode is a unidirectionally printed version of enhanced mode 2.

Figure 9:
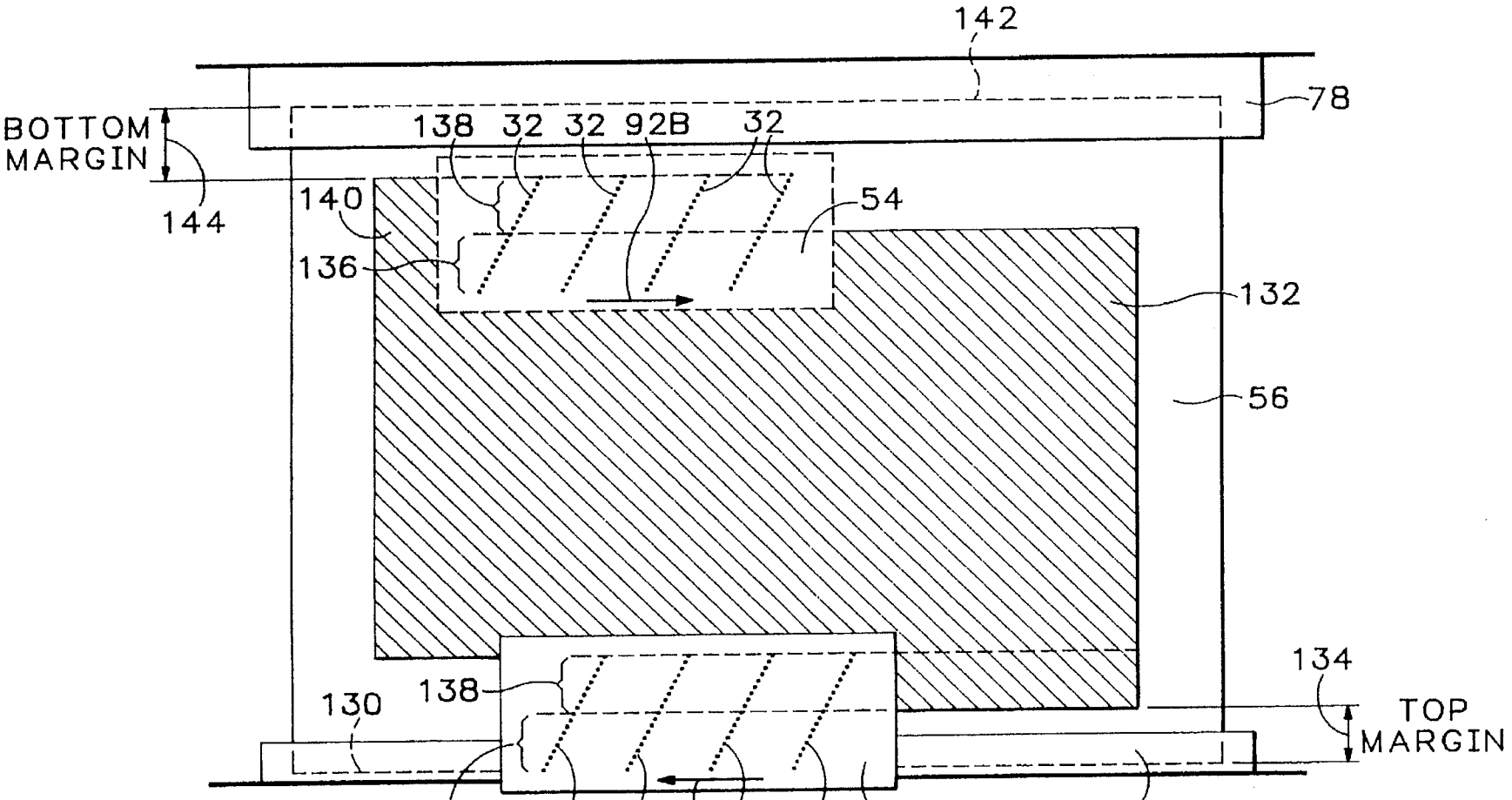
FIG. 9 is a simplified pictorial plan view of a print medium, back-tension blade, and ink-jet print head arranged for printing closer to an edge of the print medium in a manner according to this invention.

Referring to FIGS. 6 and 9, drum 58 has a 15.24-centimeter diameter that supports print medium 56 while print head 54 scans back and forth ejecting ink drops that form a printed image. A leading edge 130 (shown in dashed lines) of print medium 56 is gripped by media clamp 66. A printing area 132 of print medium 56 is held taut against surface 58 of drum 60 by spring-loaded back-tension blade 78.

As described above, printer 50 prints upside down. Therefore, leading edge 130 is adjacent to a top margin 134 of print medium 56. Nozzle arrays 32 of print head 54 are selectively enabled as an upper section 136 and a lower section 138. FIG. 9 shows print head 54 in solid lines at a first relative printing position and in dashed lines at a second relative printing position. In operation, print head 54 does not move vertically, but as FIG. 9 portrays, print medium 56 moves vertically relative to print head 54 by being drawn vertically downward by media clamp 66 from under stationary back-tension blade 78.

The second (dashed line) position shows lower section 138 of print head 54 printing a first scan of interlaced band 140 on printing area 132. In this position, a bottom edge 142 (shown in dashed lines) of print medium 56 is about to emerge from under back-tension blade 78. This presents a problem because width specifications for a bottom margin 144 typically require printing relatively close to bottom edge 142 of print medium 56, and media 56 must still be moved another 31 lines to print the second scan of interlaced band 140 in the manner described with reference to FIGS. 7A–7B. However, if print medium 56 is moved down as required, it may emerge from under back-tension blade 142 and interfere with the motion of print head 54. Printer 50 is, therefore, prevented from printing as close to bottom edge 142 as the width specifications may require.

A solution for printing closer to bottom edge 142 is provided by printer controller 100, which selectively enables printing by sections of nozzle arrays 32. For standard mode, print enabling is preferably applied to half-array sections 136 and 138. For enhanced and premium modes, print enabling is preferably applied to quarter-array sections so that printing may be selectively applied to any of the resulting four nozzle sections. Because the arrays of this invention include an odd number of nozzles, one of the array sections will have one less nozzle than the other sections.

Assuming for the moment that arrays 32 each contain 15 nozzles, for the standard printing mode FIGS. 7A, 7B and 9 show that printing closer to bottom edge 142 entails the following process, which also assumes that line number 46 is the closest printer 50 can normally print to bottom edge 142.

Repeating scans 114 and 116, wherein nozzles 1–15 are enabled for printing, provides normal interlaced printing for a majority of printing area 132.

During a final one of scan 116, all nozzles 1–15 are enabled for printing odd lines 17–45 of interlaced band 140.

Rather than stepping print medium 56 down another 15 lines, print medium 56 is stepped down only a single line increment 146.

Print head 54 nozzles 1–7 are disabled and nozzles 8–15 (lower section 138) are enabled.

Print data that would normally drive nozzles 1–8 are shifted downward to nozzles 8–15.

Combining single print medium step 146 with the seven-nozzle print data shift properly aligns enabled nozzles 8–15 to complete interlaced printing of even lines 32–46 of interlaced band 140 during a last scan 148 in direction 92B.

In printer 50, arrays 32 vertically span 61 lines. At a preferred center-to-center line spacing of 0.085 millimeter, this method allows printing about 0.25 millimeter closer to bottom edge 142 and saves 30 drum steps.

For enhanced and premium modes, print enabling is preferably applied to quarter-array sections so that printing may be selectively applied to any of the resulting four sets of nozzles. Printing closer to edge 142 of print medium 56 is accomplished as shown below with reference to Table 2 and exemplary 15-nozzle array 110 of FIGS. 8A–8C. In Table 2, nozzles 1–3 are in head section 1, nozzles 4–7 are in head section 2, nozzles 8–11 are in head section 3, and nozzles 12–15 are in head section 4.

TABLE 2

| Scan No. | Enabled Head Sections | Drum Steps at end | Pixel Columns | Pixel Line Nos. |
|---|---|---|---|---|
| 1 | 4 | 7 | Even (E) | Even: 2,4,6,8 |
| 2 | 3,4 | 7 | Odd (O) | Odd: 1,3,5,7...13,15 |
| 3 | 2,3,4 | 7 | Odd | Even: 0,2,4,6...20,22 |

TABLE 2-continued

| Scan No. | Enabled Head Sections | Drum Steps at end | Pixel Columns | Pixel Line Nos. |
|---|---|---|---|---|
| 4 | 1,2,3,4 | 9 | Even | Odd: 1,3,5,7...27,29 |
| 5... | 1,2,3,4 | Continue | Continue | Continue |
| | | 7-7-7-9 | E-O-O-E | Scan 5 starts at line 10 where scan 1 ended |
| −2 | 1,2,3 | 1 if 7* 3 if 9* | Continue | Continue Top sect. disabled |
| −1 | 2,3 | 7 or 9 | Continue | Continue Center 2 sect. enabled |
| Last | 3 | None | Continue | Continue |

Table 3 shows the corresponding stepping and nozzle enabling sequences for preferred 31-nozzle arrays 32. In Table 3, nozzles 1–7 are in head section 1, nozzles 8–15 are in head section 2, nozzles 16–23 are in head section 3, and nozzles 16–31 are in head section 4.

TABLE 3

| Scan No. | Enabled Head Sections | Drum Steps at end | Pixel Columns | Pixel Line Nos. |
|---|---|---|---|---|
| 1 | 4 | 15 | Even | Even: 2,4,6,8...14,16 |
| 2 | 3,4 | 15 | Odd | Odd: 1,3,5,7...29,31 |
| 3 | 2,3,4 | 15 | Odd | Even: 2,4,6,8...44,46 |
| 4 | 1,2,3,4 | 17 | Even | Odd: 1,3,5,7...59,61 |
| 5... | 1,2,3,4 | Continue | Continue | Continue |
| | | 15-15-15-17 | E-O-O-E | Pass 5 starts at row 18 where pass 1 ended |
| −2 | 1,2,3 | 1 if 15* 3 if 17* | Continue | Continue Top sect. disabled |
| −1 | 2,3 | 15 or 17 | Continue | Continue Center 2 sect. enabled |
| Last | 3 | None | Continue | Continue |

As indicated by an asterix "*" in Tables 2 and 3, rather than rotating drum 60 the normal number of steps prior to the second-to-last scan (scan −2), drum 60 is rotated only one or three steps and the head section enabled for printing the same print data is shifted up one section. In other words, head sections 1 and 2 would normally be enabled if the drum stepping sequence continued unchanged. But, as with the standard printing mode, shifting the print data and stepping the drum by only a small increment allows printing closer to bottom edge 142 of print medium 56.

Skilled workers will recognize that portions of this invention may have alternative embodiments. For example, the number of arrays per print head may vary as may the number of nozzles per array, provided there are an odd number of nozzles in each array. Likewise, print enabling of nozzle array sections may be carried out by other than the two- and four-section alternatives described and may entail the use of logical gating, multiplexing, software-based data enabling, and the like. Of course, various horizontal and vertical nozzle spacings, print media and print head relative positioning systems, and print medium orientations may be employed as may other than drum-type print media supports.

Of course, skilled workers will also recognize that embodiments of this invention in which the terms odd and even are reversed will operate in a manner equivalent to the above-described embodiments.

It will be obvious to those having skill in the art that many changes may be made to the details of the above-described embodiments of this invention without departing from the underlying principles thereof. Accordingly, it will be appreciated that this invention is also applicable to printing applications other than those found in phase-change ink-jet printing. The scope of the present invention should, therefore, be determined only by the following claims.

We claim:

1. A method of interlaced printing with an ink-jet printer having a print head that repetitively scans a print medium in a print head scanning direction, the print medium moving in a direction substantially orthogonal to the print head scanning direction, the method comprising the steps of:

providing a linear nozzle array in the print head, the nozzle array having an odd number of nozzles that are spaced apart in the direction of print medium movement a distance of about two line-widths;

enabling all of the nozzles in the nozzle array for printing;

printing on the print medium by ejecting ink through the nozzle during a first scan of the print head an odd-numbered line set of an image;

moving the print medium a predetermined number of line-widths substantially equal to the number of nozzles in the array;

enabling all of the nozzles in the nozzle array for printing;

printing on the print medium by ejecting ink through the nozzles during a second scan of the print head an even-numbered line set of the image;

moving the print medium the predetermined number of line-widths substantially equal to the number of nozzles in the array;

printing on the print medium during a next-to-last scan of the print head an even-numbered line set of the image;

moving the print medium a distance of about one line width;

disabling a first section of the nozzles in the nozzle array from printing;

enabling a second section of the nozzles in the nozzle array for printing;

shifting the print data normally supplied to the first section of the nozzle array to the second section of the nozzle array; and printing closer to an edge of the print medium during a substantially last scan of the print head than would be possible without the disabling and shifting steps.

2. The method of claim 1 in which the print lead scanning is bidirectional.

3. A method for interlaced printing with an ink-jet printer having a print head that repetitively scans a print medium in a print head scan direction capable of selectively printing an image in an even numbered set of pixel columns and an odd numbered set of pixel columns in successive scans, the image having a plurality of line sets, the line sets being even and odd numbered, and the print medium moves in a direction substantially orthogonal to the print head scanning direction, the method comprising the steps of:

providing a linear nozzle array in the print head, the nozzle array having an odd number of nozzles that are spaced apart in the direction of print medium movement a distance of about two line-widths;

printing on the print medium by ejecting ink through the nozzles during a first scan of the print head only in an even-numbered set of pixel columns located in a first line set of an image that is even numbered;

moving the print medium a predetermined number of line-widths;

printing on the print medium by ejecting ink through the nozzles during a second scan of the print head only in an odd-numbered set of pixel columns located in a second line set of the image that is odd numbered;

moving the print medium a number of line-widths substantially equal to the predetermined number;

printing on the print medium by ejecting ink through the nozzles during a third scan of the print head only in one of the odd-numbered set of pixel columns and the even-numbered set of pixel columns located in a third line set of the image that is even numbered;

moving the print medium a number of line-widths substantially equal to the predetermined number;

printing on the print medium by ejecting ink through the nozzles during a fourth scan of the print head only in one of the even-numbered set of pixel columns and the odd-numbered set of pixel columns located in a fourth line set of the image that is odd numbered; and moving the print medium a number of line-widths substantially equal to the predetermined number.

4. The method of claim 3 in which the first, second, third, and fourth scans are all in a same scanning direction.

5. The method of claim 3 in which the number of line-widths which the print medium is moved after each printing step equals about half the number of nozzles in the nozzle array.

* * * * *

UNITED STATES PATENT AND TRADEMARK OFFICE

CERTIFICATE OF CORRECTION

PATENT NO. : 5,625,389
DATED : April 29, 1997
INVENTOR(S) : Joern B. Ericksen, Michael D. Stevens, Howard V. Goetz It is certified that error appears in the above-indentified patent and that said Letters Patent is hereby corrected as shown below:

Claim 2, line 1 - after "print," change "lead" to --head--.

Signed and Sealed this

Ninth Day of September, 1997

*Attest:*

Bruce Lehman

BRUCE LEHMAN

*Attesting Officer*

*Commissioner of Patents and Trademarks*